United States Patent [19]

Sweeney et al.

[11] Patent Number: 4,575,382

[45] Date of Patent: Mar. 11, 1986

[54] THERMAL STABILIZED VEGETABLE OIL EXTENDED DIESEL FUELS

[75] Inventors: William M. Sweeney, Wappingers Falls; Donald R. Lachowicz, Fishkill, both of N.Y.

[73] Assignee: Texaco Inc., White Plains, N.Y.

[21] Appl. No.: 747,197

[22] Filed: Jun. 21, 1985

[51] Int. Cl.[4] ..... C10L 1/22

[52] U.S. Cl. ..... 44/57; 44/62; 44/66; 44/72

[58] Field of Search ..... 44/57, 62, 66, 71

[56] References Cited

U.S. PATENT DOCUMENTS

| | | | |
|---|---|---|---|
| 4,160,739 | 7/1979 | Stambaugh et al. | 44/62 |
| 4,161,452 | 7/1979 | Stambaugh et al. | 44/62 |
| 4,359,324 | 11/1982 | Elsea, Jr. et al. | 44/57 |
| 4,397,655 | 8/1983 | Sweeney | 44/66 |
| 4,526,586 | 7/1985 | Schwab et al. | 44/66 |

*Primary Examiner*—Y. Harris-Smith

*Attorney, Agent, or Firm*—Robert A. Kulason; James J. O'Loughlin; Vincent A. Mallare

[57] ABSTRACT

A middle distillate fuel composition containing thermally-stabilized middle distillate containing a hydrocarbon boiling in the middle distillate boiling range, an extending vegetable oil and a thermal-stabilizing amount of a nitrogen-containing polymer prepared by sequentially reacting an ethylene/propylene copolymer with maleic anhydride, an alcohol and dimethylaminopropylamine, thereby forming a nitrogen-containing copolymer.

16 Claims, No Drawings

THERMAL STABILIZED VEGETABLE OIL EXTENDED DIESEL FUELS

FIELD OF THE INVENTION

This invention relates to middle distillates, and more particularly to a vegetable-oil-containing middle distillate fuel characterized by an improved thermal stability.

BACKGROUND OF THE INVENTION

Generally, it is known that middle distillate fuels such as aviation jet fuels and diesel fuels form gums and deposits on storage, particularly when the storage is at an elevated temperature. These gums and deposits are undesirable because they tend to interfere with the operation of the engine by partially or wholly clogging narrow passageways through which fuels must pass.

Thermal stability is a desired quality in distillate fuels used in jet airplanes and modern diesel vehicles. In the latter instance, the fuel injectors with extremely small idle relief holes need to be kept clean to minimize particulate emissions at idle speed. These idle ports can become plugged, causing rough idling and stalling of the car. The improving of the thermal stability of the distillate fuel would help to avoid such problems.

Thus, it is an object of this invention to improve the thermal stability of diesel fuels and particularly those which are extended with vegetable oil. Other objects will be apparent to those skilled in the art.

SUMMARY OF THE INVENTION

The present invention provides a middle distillate fuel extended with a vegetable oil as having an enhanced thermal stability. According to the present invention, the novel middle distillate fuel composition of the present invention comprises (a) a major portion of a middle distillate containing a hydrocarbon boiling in the middle distillate boiling range of about 300° F. to about 700° F.;

(b) an extending portion of a vegetable oil; and (c) a thermal-stabilizing amount of a nitrogen-containing polymer prepared by reacting an ethylene/propylene copolymer with maleic anhydride, thereby forming a succinic anhydride, reacting the succinic anhydride, with a ($C_4$–$C_{30}$) alcohol, thereby forming succinate ester while leaving a portion of the succinic anhydride unreacted, and, reacting the succinate ester and said unreacted succinic anhydride with dimethylaminopropylamine, thereby forming a nitrogen-containing polymer.

DESCRIPTION OF THE INVENTION

The fuels which may be used in the practice of the process of this invention include middle distillate fuels which boil above gasolines and below heavier lube oils. Middle distillate fuels contain hydrocarbons which boil in the middle distillate boiling range ranging from about 300° F. to about 700° F. Typically these fuels have an IBP of 270°–400° F., typically 340°–400° F., preferably about 350° F.; a 50% BP of 400° F.–670° F., typically 420° F.–520° F., preferably about 470° F.; and an EP of 500° F.–660° F., typically 525° F.–640° F., preferably about 520° F. Typical middle distillates may include kerosene, diesel fuel, light cycle gas oil, and intermediate light cycle gas oil.

The typical diesel fuel may be characterized by an IBP of 357° F., a 50% BP of 478° F., and an EP of 615° F., an API Gravity of 40.5, and a Cetane No. of 45.

The Base Diesel Fuel in which the additive of the invention may be used to form a diesel fuel composition, may comprise a mixture of hydrocarbons boiling in the diesel fuel boiling range. This base fuel may contain straight chain or branched chain paraffins, cycloparaffins, olefins, and aromatic hydrocarbons and any mixture of these. A typical Base Diesel Fuel may be No. 2-D as designated by ASTM and as characterized below in Table I.

TABLE I

| Property (ASTM Test Procedure) | Value |
|---|---|
| API Gravity D-1298 | 37.3 |
| Kin. Vis. cSt °40° C. D-445 | 2.27 |
| Cetane D-613 | 43.6 |
| Distillation D-86 (°F.) | |
| IBP | 369 |
| 50% | 496 |
| 90% | 596 |
| EP | 627 |

An important feature of this invention is to extend middle distillates such as No. 2-D diesel fuels by the addition thereto of a vegetable oil. The vegetable oils which may be used according to the present invention include soybean oil, peanut oil, and sunflower seed oil.

An extending portion of the vegetable oil is typically about 5 to about 15 parts, preferably about 10 parts by volume of the vegetable oil per 100 parts by volume of diesel fuel. In a typical mixture, this corresponds to about 80 to about 95 v%, preferably about 90 v% of diesel fuel, and about 5 to about 20 v%, preferably about 10% v% of vegetable oil.

According to the present invention, there may be added to a major portion of the vegetable-oil-extended diesel fuel, a thermal-stabilizing amount of a nitrogen-containing copolymer which is prepared by the sequential reactions of an ethylene/propylene copolymer with first, maleic anhydride, then, a ($C_4$–$C_{30}$) alcohol, and thirdly, an amine.

The ethylene/propylene copolymer has a molecular weight ($\overline{M}$) ranging from about 800 to about 200,000 and preferably about 20,000 to about 100,000.

The alcohols which may be used according to the present invention are ($C_4$–$C_{30}$) alcohols including, 2-methyl-2-butanol, n-butanol, sec-butanol, n-octanol, n-tetradecanol, lauryl alcohol, and stearyl alcohol. The amine or amines which may be used according to the present invention include dimethylaminopropylamine and diethylaminopropylamine. The preferred amine being dimethylaminopropylamine.

In thermal-stabilizing the vegetable-oil-extended diesel fuel, the amount of additive provided in the extended diesel fuel ranges from about 0.01 to about 0.5 wt. %.

In preparing the nitrogen-containing copolymer, initially an ethylene/propylene copolymer is reacted with maleic anhydride to form a succinic anhydride; then, the succinic anhydride is reacted with a ($C_4$–$C_{30}$) alcohol, thereby forming succinate ester while leaving a portion of the succinic anhydride unreacted; and lastly, the succinate ester and the unreacted succinic anhydride are reacted with dimethylaminopropylamine to form a nitrogen-containing polymer which is a combination product of succinate ester, succinimide and a tertiary amine represented by

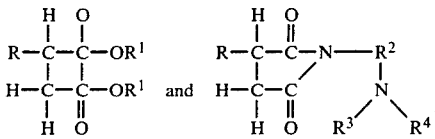

wherein R is an alkyl group derived from the ethylene/-propylene copolymer, $R^1$ is a ($C_4$–$C_{30}$) alkyl group, $R^2$ is a $C_3$ alkylene group, and $R^3$ and $R^4$ are ($C_1$–$C_4$) alkyl groups.

This combination product, ethylene/propylene copolymer succinate ester-succinimide-amine (EPC-EIA) as shown above, is quite effective in thermally stabilizing a vegetable-oil-extended diesel fuel.

In another embodiment, the vegetable-oil-extended diesel fuel may be thermally stabilized by a two component additive which consists of N,N'-disalicylidene-1,2-propane diamine and nitrogen-containing copolymer which is prepared by the sequential reactions of an ethylene/propylene copolymer with first, maleic anhydride and then, dialkylaminoalkylamine to provide a nitrogen-containing copolymer which is a succinimide.

In preparing the nitrogen-containing copolymer for the second embodiment of this invention, initially an ethylene/propylene copolymer is reacted with maleic anhydride to form a succinic anhydride, and then the succinic anhydride is reacted with dimethylaminopropylamine to form a nitrogen-containing polymer which is a succinimide having the formula

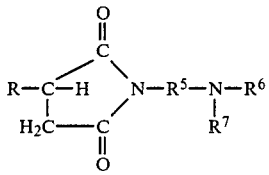

wherein R is an alkyl group derived from the ethylene/-propylene copolymer, $R^5$ is a ($C_1$–$C_4$) alkylene group, and $R^6$ and $R^7$ are ($C_1$–$C_4$) alkyl groups.

The N,N'-disalicylidene-1,2-propane diamine is represented by the formula

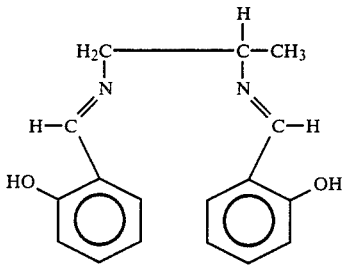

When this two-component additive is provided, it may consist of about 5 PTB of N,N'-disalicylidene-1,2-propane diamine (DSPD) and from about 0.01 to about 0.5 wt. % of the ethylene propylene copolymer reaction product, i.e., ethylene/propylene copolymer succinimide-amine (EPC-IA).

In extending the diesel fuel with a vegetable oil, the weight ratio of diesel fuel to vegetable oil ranges from about 49:1 to about 4:1. When the additive EPC-EIA is added to thermally stabilize the extended diesel fuel, the weight ratio of diesel fuel to EPC-EIA ranges from about 10,000:1 to about 200:1.

In the preparation of the additives, EPC-EIA and EPC-IA, the weight ratio of ethylene/propylene copolymer to maleic anhydride ranges from about 6:1 to about 7.5:1; the weight ratio of ethylene/propylene copolymer to the ($C_4$–$C_{30}$) alcohol ranges from about 1.4:1 to about 1.8:1.0; and the weight ratio of ethylene/-propylene copolymer to dimethylaminopropylamine ranges from about 45:1 to about 70:1.

The effectiveness in a fuel of the additives, i.e., the ethylene/propylene copolymer succinate ester-succinimide amine (EPC-EIA) alone, and the two-component additive of the ethylene/propylene copolymer succinimide-amine (EPC-IA) with DSPD, may be determined by a coker thermal stability test. The results of the test are a rating of from 0 to 4. If the rating obtained is 2 or lower, then the additive is sufficient. However, if the rating is greater than 2, i.e., 3 or 4, then the additive is not sufficient and fails the coker thermal stability test. The following is a description of the CRC Fuel Coker Thermal Stability Test.

CRC FUEL COKER THERMAL STABILITY TEST

Seven gallons of test fuel are used in this test. The test fuel is contained in a stainless steel milk can held at room temperature (about 75° F.). Before the start of the test, room air is blown into the bottom of the milk can through a glass passage for 3 minutes to saturate the test fuel with air. The test fuel is pumped at 6 lbs/hr by a gear pump for 5 hours into the test apparatus where fuel pressure is maintained at 150 psig throughout the duration of the test. The test apparatus consists of two main parts which are designed to stress the test fuel thermally. The first part consists of an aluminum heater rod about ½ inch diameter with polished surface about 14 inches long. This rod is inserted inside another tube and centered precisely, creating a narrow annular space through which test fuel is first pumped and heated by the center aluminum rod to a desired temperature. The fuel is rated on the basis of the amount and color of deposit on the surface of the polished aluminum rod from the inlet to the outlet of the annular space which is divided into 131-inch segments and each segment is rated separately as compared to a standard color chart which has deposits noted from 0 to 4. Zero signifies best rating (no deposit) and 4 signifies heavy deposit. A rating of 2 or lower is passing while 3 or 4 is failing.

The second part of the test apparatus consists of a metal sintered filter about ⅜ inches in diameter which is housed in the center of a small heater. The temperature of the filter is maintained 100° F. higher than the aluminum rod. The fuel flows directly from the annular space around the aluminum heating rod in the filter housing. A manometer is connected to the filter to measure any pressure drop due to accumulation of any deposits plugging the sintered filter. Any pressure rating over 2 inches fails the fuel. Fuel flows through the test apparatus on a once-through basis and is discarded after the test.

The practice of the present invention will be apparent to those skilled in the art from the following Examples wherein, as elsewhere in the specification, all parts are by weight unless otherwise specified.

EXAMPLE I

The preparation of the additive, EPC-IA, a succinimide, may be prepared by the following process wherein the materials used for producing such additive are:

| Charge Materials | Lbs |
|---|---|
| E-P Copolymer, 7.6 wt. % copolymer in cyclohexane | 197.0 |
| Monochlorobenzene | 21 grams |
| Maleic Anhydride, pellets | 1.2 |
| Dicumyl Peroxide | 21 |
| Solvent Neutral Oil | 135.0 |
| Dimethylaminopropylamine | 1.2 |
| Nitrogen-as required | — |
| Dicalite Speedplus | 3.0 |

In this process, an ethylene/propylene copolymer was charged to a reactor and stripped at 176° F. to remove 47 pounds of cyclohexane to form a 10 wt. % polymer solution.

The monochlorobenzene was charged to the polymer solution and the mixture was stripped to 278° F. reactor temperature to form a 25 wt. % polymer-monoclorobenzene solution. The overhead amounted to 188 pounds. Then maleic anhydride and dicyl peroxide were charged to the solution at 266° F. and reacted for about 6 hours. A sample of the reactant was taken for IR analysis. The analysis indicated a 2.5 absorption ratio. Then, solvent neutral oil was changed to the reaction to produce a 10 wt. % concentrate and the mixture was stripped to 420° F. at 20 mm Hg absolute pressure to remove the remaining monochlorobenzene and maleic anhydride, and cooled to 275° F. Then, dimethylaminopropylamine was charged and reacted for 2 hours at 257°, stripped to 420° F. and 20 mm Hg absolute pressure and cooled to 210° F. and filtered. The filter rate of 2.4 gallons/hour/square foot was obtained at 210° F. and 20 psig using a grade "A" paper and speed plus as an admixture. A total of 142.5 pounds of product, a 10 wt. % solution of the additive EPC-IA in Solvent Neutral Oil, was recovered.

EXAMPLE II

The additive EPC-EIA was prepared according to the following process with the following charge materials:

| Charge Materials | | Lbs |
|---|---|---|
| Monochlorobenzene | | 110.0 |
| E-P Copolymer, 30.4 wt. % Polymer, Hexane Rubber Cement | | 49.4 |
| Maleic Anhydride | | 2.25 |
| Dicumyl Peroxide | (82.0 grams) | 0.18 |
| Solvent Neutral Oil | | 135.0 |
| Stearyl Alcohol | | 1.9 |
| Lauryl Alcohol | | 7.3 |
| p-Toluene Sulfonic Acid | (55 grams) | 0.12 |
| Dimethylaminopropylamine | (106 grams) | 0.234 |
| Dicalite Speedplus | | 1.5 |
| Nitrogen - as required | | |

In the process of preparing EPC-EIA, an ethylene/propylene copolymer rubber cement was charged to the monochlorobenzene in a reactor and stripped to a 20 wt. % concentrate at 274° F. pot temperature to remove the hexane. Maleic anhydride and dicumyl peroxide were charged and the mixture was reacted at 168° F. for 8 hours. A sample of the product was taken for an IR analysis to determine the amount of bound anhydride on the copolymer chain.

Then, solvent neutral oil was charged to produce a 10 wt. % concentrate, and the mixture was stripped of 53.0 pounds overhead at 420° F. and 20 mm Hg absolute pressure for 3 hours and cooled to 374° F. At this temperature, it was observed that the viscosity of the reactor contents was at a very high critical stage for stirring.

The stearyl alcohol was then charged and the mixture cooled to 320° F. Then, the lauryl alcohol and p-toluene sulfonic acid (0.06 pounds) were charged and the mixture reacted at 320° F. for two hours. At this point it was observed that the reaction content had become much more fluid. An additional portion of p-toluene sulfonic acid (0.06 pounds) was charged and the contents reacted at 392° F. for 2 hours. A sample of the product was taken and the IR analysis indicated a high degree of reaction had been obtained.

The contents of the reactor were then cooled to 257° F., and dimethylaminopropylamine was charged and the mixture was reacted at 258° F. for 2 hours and stripped at 420° F. and 20 mm Hg absolute pressure for 2 hours to remove traces of water and any unreacted lower boiling alcohol. The stripped product was filtered using a sparkler pressure plate filter with 1.0 wt. % Dicalite Speedplus as an admixture at 250° F. and 20 psig. A filter rate of 4.2 gallons/hour/square foot was obtained at a throughput of 20.8 gallons/square foot. The recovered product was a 11.8 wt. % solution of the additive EPC-EIA in solvent neutral oil.

EXAMPLE II

In order to determine the effectiveness of the additive (EPC-EIA) and the two-component additive of (EPC-IA) and DSPD, the coker thermal stability test was used to test different fuel compositions including a Base Diesel Fuel (BDF) alone, BDF extended with a vegetable oil alone, and the extended diesel fuel with the single additive (EPC-EIA) and the extended diesel fuel with the two-component additive (EPC-IA) and DSPD. In the test, the temperature of the preheater and filter was recorded as well as the rating obtained from the coker test below in Table II.

TABLE II

| | THERMAL STABILITY CRC COKER | |
|---|---|---|
| Fuel Composition | Preheater/Filter Temp. °F. | Rating |
| BDF 100% | 350/450 | 1 |
| | 400/500 | 4 |
| BDF/Soya 90/10 | 350/450 | 4 |
| BDF/Soya 90/10 + 5 PTB DSPD | 350/450 | 3 |
| BDF/Soya 90/10 + 0.05% EPC-IA | 350/450 | 4 |
| BDF/Soya 90/10 + 5 PTB DSPD + 0.05% EPC-IA | 350/450 | 1 |
| BDF/Soya (90/10) + 0.05% EPC-EIA | 350/450 | 1 |

BDF: Base Diesel Fuel
Soya: Soybean oil
DSPD: N,N'—disalicylidene-1,2-propane diamine
EPC-IA: ethylene/propylene copolymer succinimide-amine
EPC-EIA: ethylene/propylene copolymer succinate ester-succinimide-amine The results provided in Table II above show that in the case of vegetable-oil-extended diesel fuels that an additive is needed in order for the composition to be thermally stabilized. In the instance where 100%, BDF, No. 2-D is tested, the thermal stability has a rating of 1 at 350°/450° F. which is the highest rating obtainable under the coker test.

However, from the results in Table II, it is clear that when either DSPD or EPC-IA is used alone that each additive fails to improve the thermal stability of the vegetable-oil-extended diesel fuel. However, where there is the addition of 5 PTB DSPD plus 0.05% EPC-IA to the extended fuel, a rating of 1 is obtained which indicates that the combination additive has a thermal stability equivalent to 100% BDF No. 2-D, i.e., diesel fuel.

Also, from Table II, it is shown that the additive EPC-EIA is quite effective when added alone to the extended diesel fuel. That is, the additive EPC-EIA obtained a rating of 1 which indicates that this additive provides a thermal stability in the extended diesel fuel equivalent to that of 100% BDF, No. 2-D.

Thus it can be concluded from these tests that when a diesel fuel is extended with vegetable oil an additive such as provided by the present invention is necessary in order to have a thermally stabilized, vegetable-oil-extended diesel fuel.

We claim:

1. A middle distillate fuel composition comprising:

(a) a major portion of a middle distillate containing a hydrocarbon boiling in the middle distillate boiling range;

(b) an extending portion of a vegetable oil; and (c) an effective thermal-stabilizing amount of a nitrogen-containing polymer prepared by reacting an ethylene/propylene copolymer with maleic anhydride, thereby forming a succinic anhydride, reacting said succinic anhydride, with an alcohol, thereby forming a succinate ester while leaving a portion of the succinic anhydride unreacted, and, reacting said succinate ester and said unreacted succinic anhydride with dimethylaminopropylamine, thereby forming a nitrogen-containing polymer.

2. A diesel fuel composition comprising:

(a) a major portion of a diesel fuel containing a hydrocarbon boiling in the diesel fuel boiling range;

(b) an extending portion of a vegetable oil; and (c) an effective thermal-stabilizing amount of, as a thermal stabilizing additive, a nitrogen-containing polymer prepared by reacting an ethylene/propylene copolymer with maleic anhydride, thereby forming a succinic anhydride, reacting said succinic anhydride with a ($C_4$–$C_{30}$) alcohol thereby forming a succinate ester while leaving a portion of the succinic anhydride unreacted, and, reacting said succinate ester and said unreacted succinic anhydride with dimethylaminopropylamine, thereby forming a nitrogen-containing polymer which is a combination product of succinate ester, succinimide and a tertiary amine,

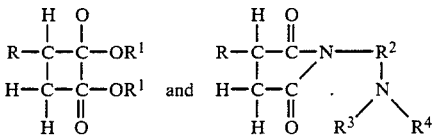

wherein R is an alkyl group derived from said ethylene/propylene copolymer, $R^1$ is a ($C_4$–$C_{30}$) alkyl group, $R^2$ is $C_3$ alkylene group, and $R_3$ and $R_4$ are ($C_1$–$C_4$) alkyl groups.

3. The diesel fuel composition of claim 2, wherein the alcohol is selected from the group consisting of lauryl alcohol and stearyl alcohol.

4. The diesel fuel composition of claim 2, wherein the vegetable oil is selected from the group consisting of soybean oil, peanut oil, and sunflower seed oil.

5. The diesel fuel composition of claim 2, wherein the ethylene/propylene copolymer has a molecular weight $\overline{M}_n$ of about 800 to about 200,000.

6. The diesel fuel of claim 2, wherein the minor amount of nitrogen-containing polymer ranges from about 0.01 to about 0.5 w %.

7. The diesel fuel composition of claim 2, wherein the weight ratio of diesel fuel to vegetable oil ranges from about 49:1 to about 4:1.

8. The diesel fuel composition of claim 2, wherein the weight ratio of diesel fuel to said nitrogen-containing polymer ranges from about 10,000:1 to about 200:1.

9. The diesel fuel composition of claim 2, wherein the weight ratio of ethylene/propylene copolymer to maleic anhydride ranges from about 6:1 to about 7.5:1.

10. The diesel fuel composition of claim 2, wherein the weight ratio of ethylene/propylene copolymer to said alcohol ranges from about 1.4:1 to about 1.8:1.

11. The diesel fuel composition of claim 2, wherein the weight ratio of ethylene/propylene copolymer to dimethylamino-propylamine ranges from about 45:1 to about 70:1.

12. A diesel fuel composition comprising:

(a) a major portion of a diesel fuel containing a hydrocarbon boiling in the diesel fuel boiling range;

(b) an extending portion of a vegetable oil; and (c) a thermal-stabilizing amount of a two-component additive consisting of (i) N,N'-disalicylidene-1,2-propane diamine, and (ii) a nitrogen-containing copolymer additive prepared by reacting an ethylene/propylene copolymer with maleic anhydride, thereby forming a succinic anhydride, reacting said succinic anhydride with dimethylaminopropylamine, thereby forming a succinimide having the formula

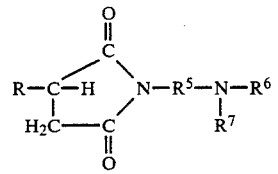

wherein R is an alkyl group derived from the ethylene/propylene copolymer, $R^5$ is a $C_3$ alkylene group, and $R^6$ and $R^7$ are ($C_1$–$C_4$) alkyl groups.

13. The diesel fuel composition of claim 12, wherein the alcohol is selected from the group consisting of 2-methyl-2-butanol, n-butanol, sec-butanol, n-octanol lauryl alcohol and stearyl alcohol.

14. The diesel fuel composition of claim 12, wherein the vegetable oil is selected from the group consisting of soybean oil, peanut oil, and sunflower seed oil.

15. The diesel fuel composition of claim 12, wherein the ethylene/propylene copolymer has a molecular weight $\overline{M}_n$ of about 800 to about 200,000.

16. The diesel fuel composition of claim 12, wherein the minor amount of nitrogen-containing polymer ranges from about 0.1 to about 0.5 wt. %.

* * * * *